US012808615B1

(12) United States Patent
O'Toole

(10) Patent No.: US 12,808,615 B1
(45) Date of Patent: Nov. 24, 2026

(54) AUTOLOADING MULTICHARGE GUN

(71) Applicant: Christopher John O'Toole, Rocky Hill, CT (US)

(72) Inventor: Christopher John O'Toole, Rocky Hill, CT (US)

( * ) Notice: Subject to any disclaimer, the term of this patent is extended or adjusted under 35 U.S.C. 154(b) by 269 days.

(21) Appl. No.: 18/641,363

(22) Filed: Apr. 20, 2024

Related U.S. Application Data

(63) Continuation-in-part of application No. 18/112,014, filed on Feb. 21, 2023, now abandoned.

(60) Provisional application No. 63/416,563, filed on Oct. 16, 2022.

(51) Int. Cl.
*F41A 3/04* (2006.01)
*F41A 1/02* (2006.01)
*F41A 9/45* (2006.01)

(52) U.S. Cl.
CPC ..... *F41A 3/04* (2013.01); *F41A 1/02* (2013.01); *F41A 9/45* (2013.01)

(58) Field of Classification Search
CPC ..... F41A 1/02; F41A 3/04
USPC ..... 89/8
See application file for complete search history.

(56) References Cited

U.S. PATENT DOCUMENTS 484,009 A * 10/1892 Haskell ..... F41B 6/006 89/8
770,320 A * 9/1904 Schneider ..... F41A 5/32 89/47
1,320,110 A * 10/1919 Aydukovich ..... F41B 6/006 89/8
2,360,217 A * 10/1944 Francis ..... F41A 1/02 42/76.01
3,459,101 A * 8/1969 Scanlon, Jr. ..... F41F 3/00 89/8
3,572,248 A * 3/1971 Dardick ..... F41A 9/46 102/434

* cited by examiner

*Primary Examiner* — Bret Hayes

(57) ABSTRACT

The secondary chambers of a multicharged gun designed to facilitate autoloading and the mechanisms to do so. The gun can be fired with an initial charge of gunpowder (traditional propellant) followed by one or more charges of high explosive (faster propellant) to overcome the speed limitations of gunpowder.

6 Claims, 7 Drawing Sheets

Figure 9
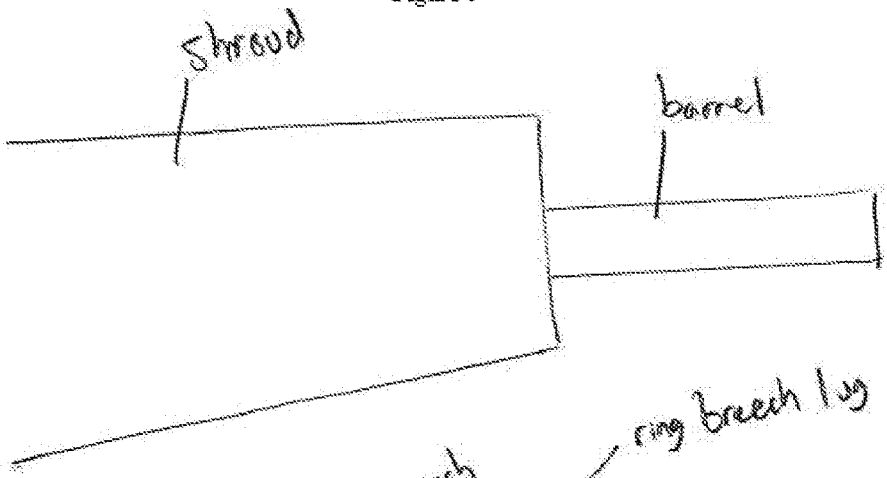
Figure 10
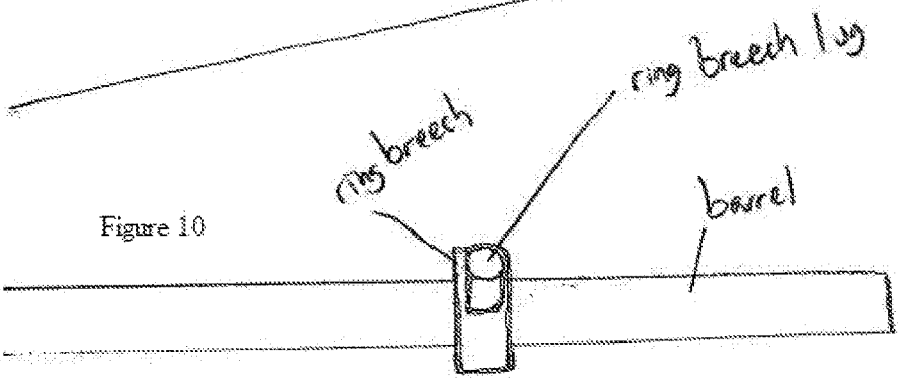
Figure 11
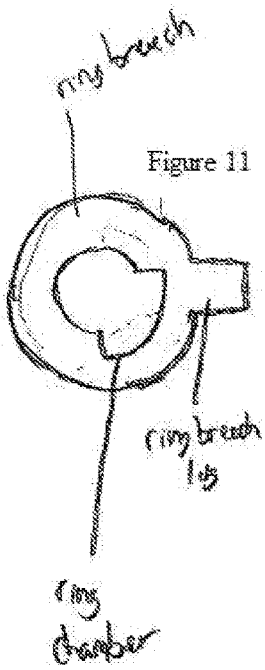
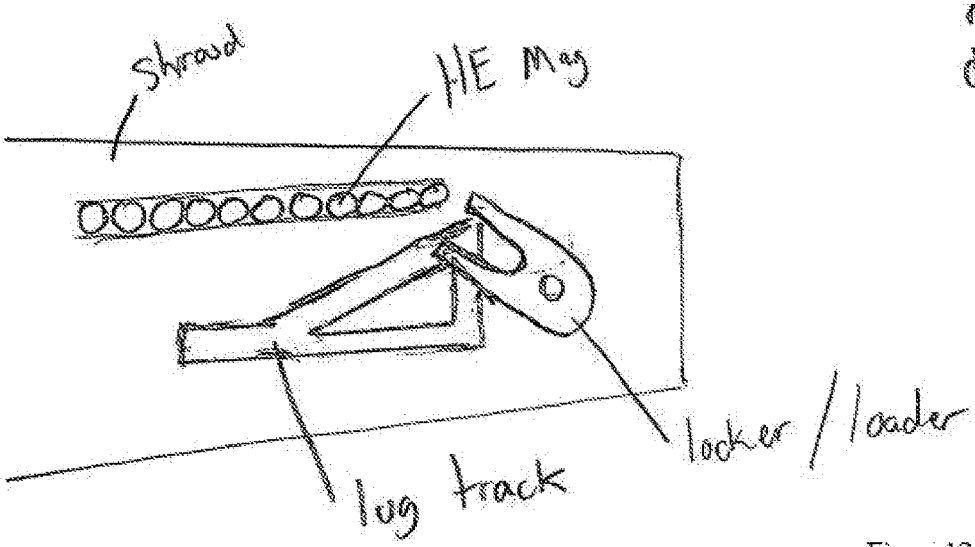
Figure 12

Figure 13
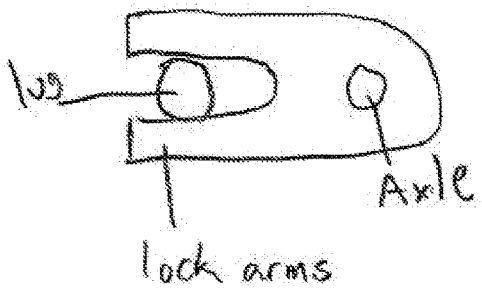
Figure 14
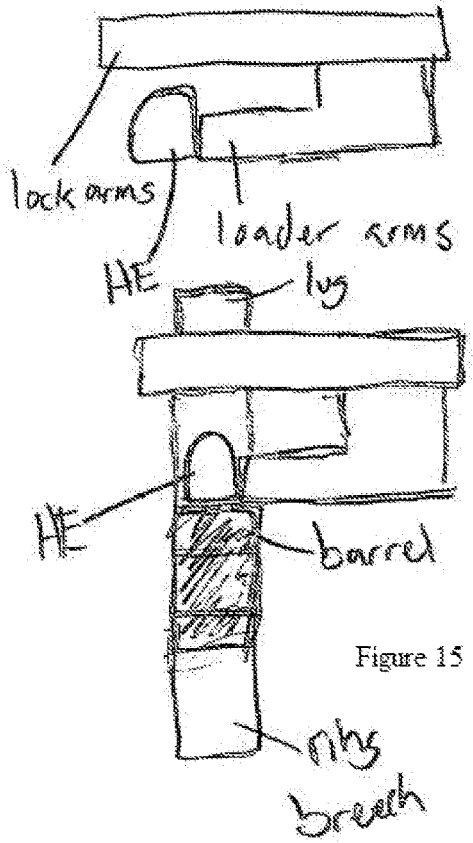
Figure 15
Figure 16
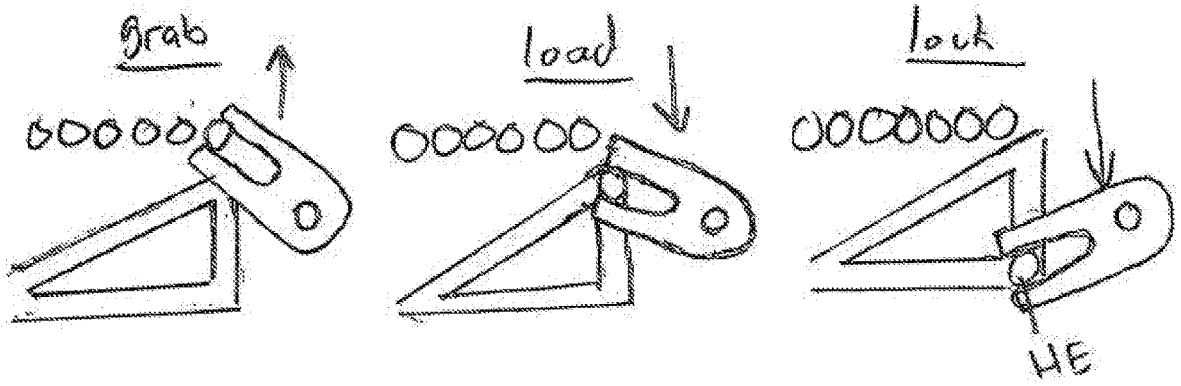

AUTOLOADING MULTICHARGE GUN

This application is a continuation-in-part to application Ser. No. 18/112,014, which claims the filing date of provisional application 63/416,563.

BACKGROUND

Field of the Invention

The present invention relates to artillery, cannons, and guns in which a projectile is projected from a barrel with some type of propellant.

Discussion of the State of the Art

In the art of guns, traditional gunpowder fired projectiles are limited in velocity by the deflagration speed of a single charge and the fortitude of a single chamber. Electronically propelled guns and other alternatives to gunpowder including "rail guns" have drawbacks and limitations with currently available technology including reliability, economic feasibility, and space constraint problems.

Many autoloading mechanisms for the primary breech of a gun have been patented and built. Said mechanisms greatly improve convenience of their use.

A handful of multicharge guns have been patented and some built. All examples up to this point have featured cumbersome manual reloading processes for the secondary breeches. No previous example features a secondary breech design that is optimized for autoloading mechanisms.

In the field of multicharge guns, a novel and distinct secondary breech design is necessary to advance the state of the art and enhance user convenience.

BRIEF SUMMARY OF INVENTION

In the present invention the projectile is initially propelled by a primary propellant, followed by one or more additional charges of a "faster" propellant eg. high explosive compound. The additional charge(s) are placed at certain distances along the barrel of the gun to increase barrel pressure and projectile energy/velocity beyond the capabilities of a single propellant charge. The additional charges are loaded by mechanisms which provide a convenient and contemporary ease of use which has come to be expected by users of traditional single chamber guns.

BRIEF DESCRIPTION OF DRAWINGS

Recoil dampening mechanisms, automatic loading mechanisms for the primary charges, primary charges, and projectiles are not claimed in this invention nor pictured. FIGS. 1-20 show a configuration of mechanisms which can be used to automatically load the ring breech and perform the necessary actions to work the gun.

FIG. 1: A cross section of the invention showing the internal positioning of the powder charge and high explosive charges aka HE caps aka secondary charges or secondary charge cartridges. A projectile is not shown.

FIG. 2: This depicts an exterior "three quarters view" of the invention.

FIG. 3: A cross section of a high explosive cap.

FIG. 4: A frontal view depicting an open and closed ring breech. The arrows indicate its rotational movement around the barrel which opens and closes the chamber providing ample space for easy loading and unloading.

FIG. 5: A "three quarters view" of the ring breech section of the barrel with ring breech removed. This shows an inlet geometry which combined with the ring breech geometry constitutes a secondary chamber "HE chamber" when in the closed position.

FIG. 6: A depiction of the ring breech which features a ring lug, which can be used for actuating the ring breech.

FIG. 7: A depiction of the lug track which guides the ring lug through the cycle of firing and loading. "Locking wedge" and "lug track" are used interchangeably. Unlocking gate ensures correct travel along the lug track, as indicated by the arrows.

FIG. 8: These 2 drawings show the range of motion of the locker/loader as it actuates the ring lug in the lug track to open and close the breech as indicated by the arrows. This configuration shows the locker and loader as being one combined arm that pivots on a single axis. These actions can also be done with the locker and loader as independent arms with independent movements/mountings depending on design constraints.

FIG. 9: This shows the mechanisms with no cutaway, housed in the receiver. "shroud" and "receiver" are used interchangeably.

FIG. 10: The parts which are on the barrel and travel with the barrel during recoil and return travel.

FIG. 11: Another depiction of the ring breech.

FIG. 12: The parts which are held by the receiver/shroud.

FIG. 13: Locker/loader top view.

FIG. 14: Locker/loader side view.

FIG. 15: Locker/loader side view with ring breech and barrel cutaway.

FIG. 16: These 3 depictions show the 3 stages of locker/loader movement as indicated by arrows.

FIG. 17: 3 quarter view of locker/loader "holding" HE cap.

FIG. 18: 3 quarter view of locker/loader with ring breech and barrel cutaway. In this configuration, the new HE cap is meant to displace the spent HE cap as it is loaded, thus unloading the spent (or unfired) HE cap. The unloaded HE Cap can fall/be jettisoned/be grabbed/etc. by some means to get it safely out of the way and disposed.

FIG. 19: The storage of the HE caps ready to be loaded. The pictured HE caps feature a "grab tab" to aid the locker/loader mechanism.

FIG. 20: Assembly of all pieces depicts a space efficient layout of the autoloading mechanisms which is made possible due to the novel geometry and movement of the ring breech.

DEFINITIONS FOR DRAWINGS

Figure 1:
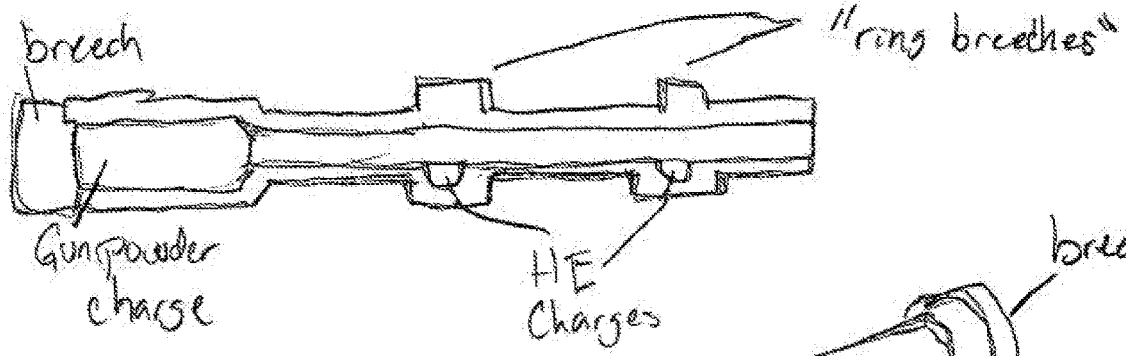
Figure 2:
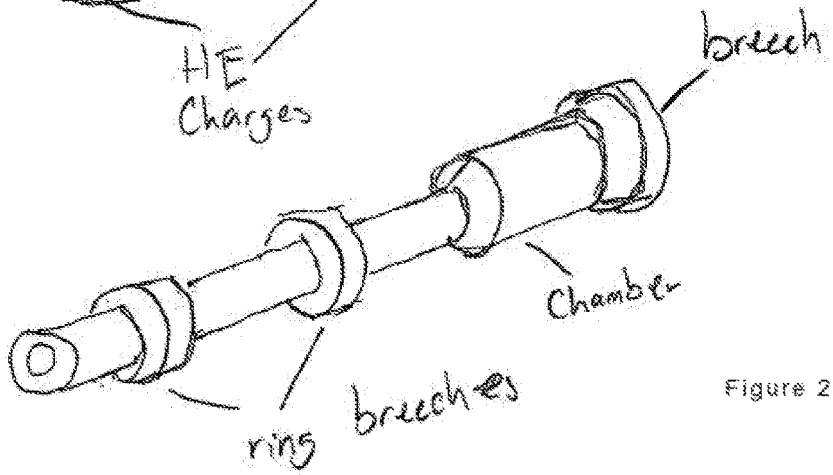
Figure 3:
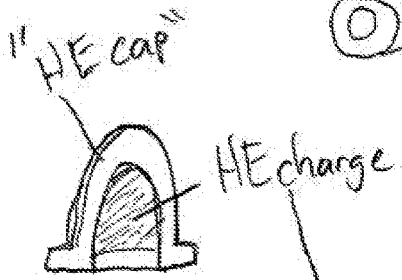
Figure 4:
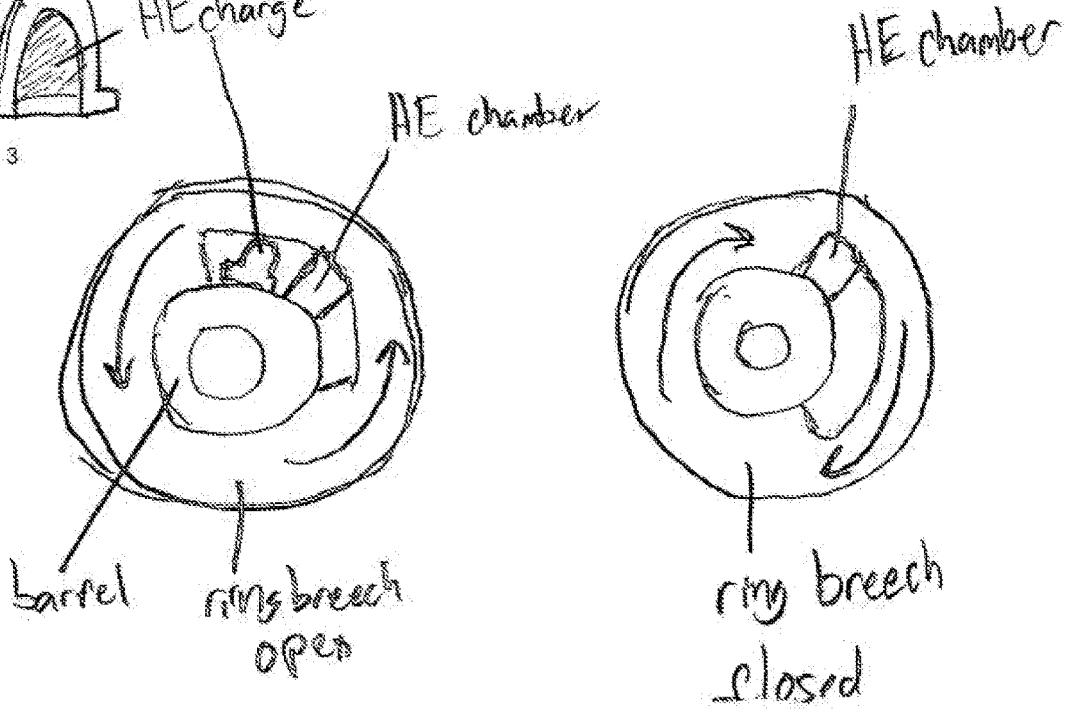
Figure 5:
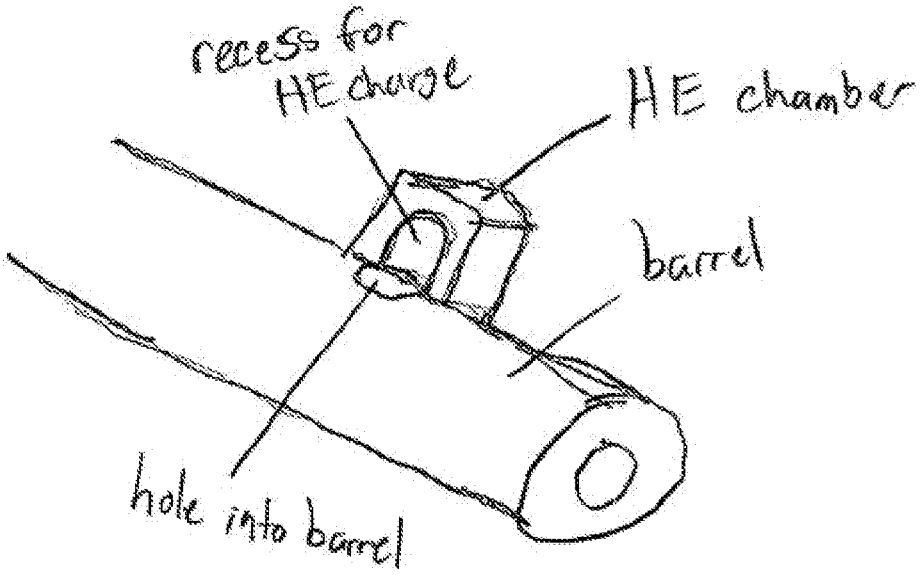
Figure 6:
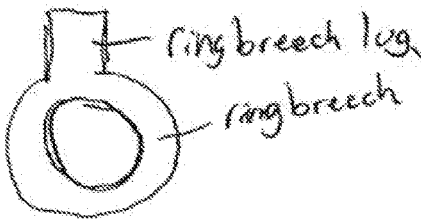
Figure 7:
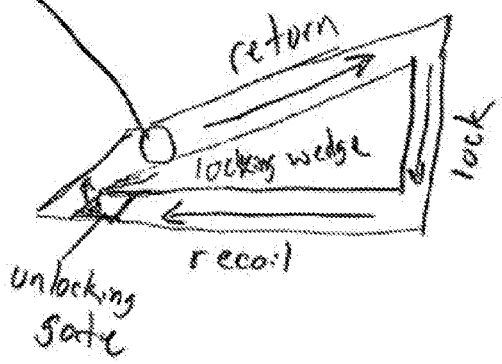
Figure 8:
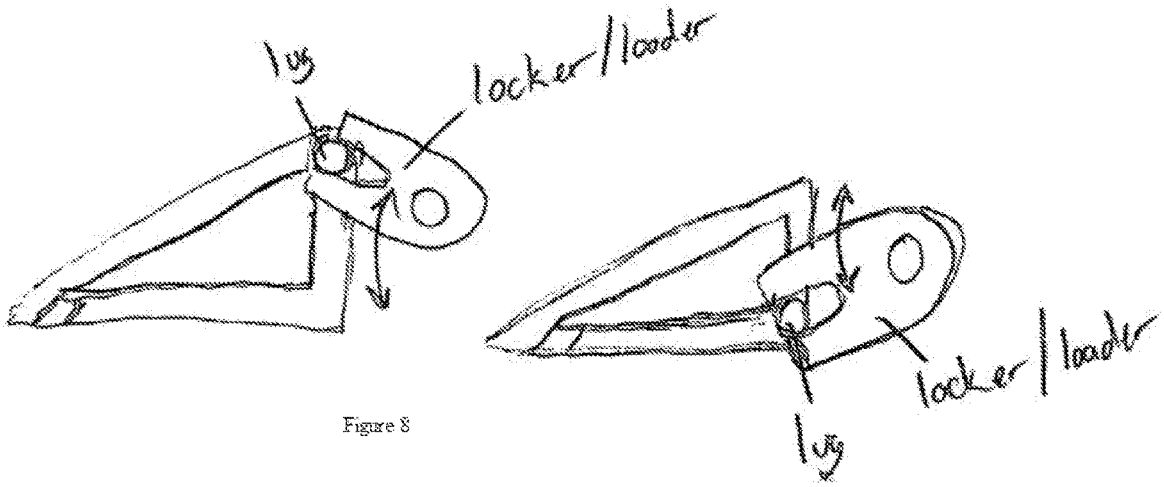
Figure 17:
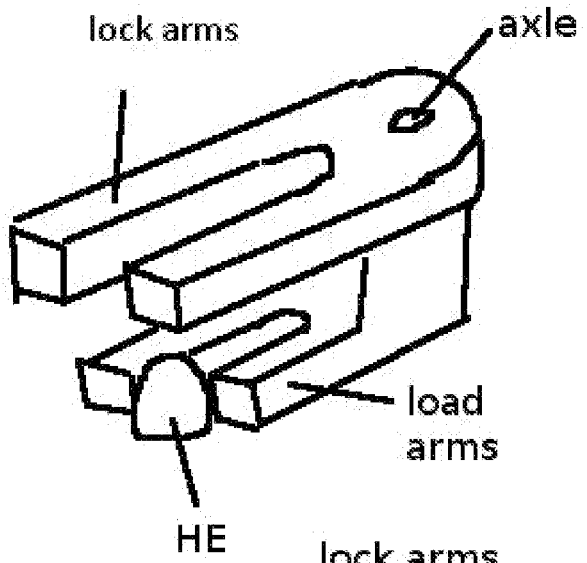
Figure 18:
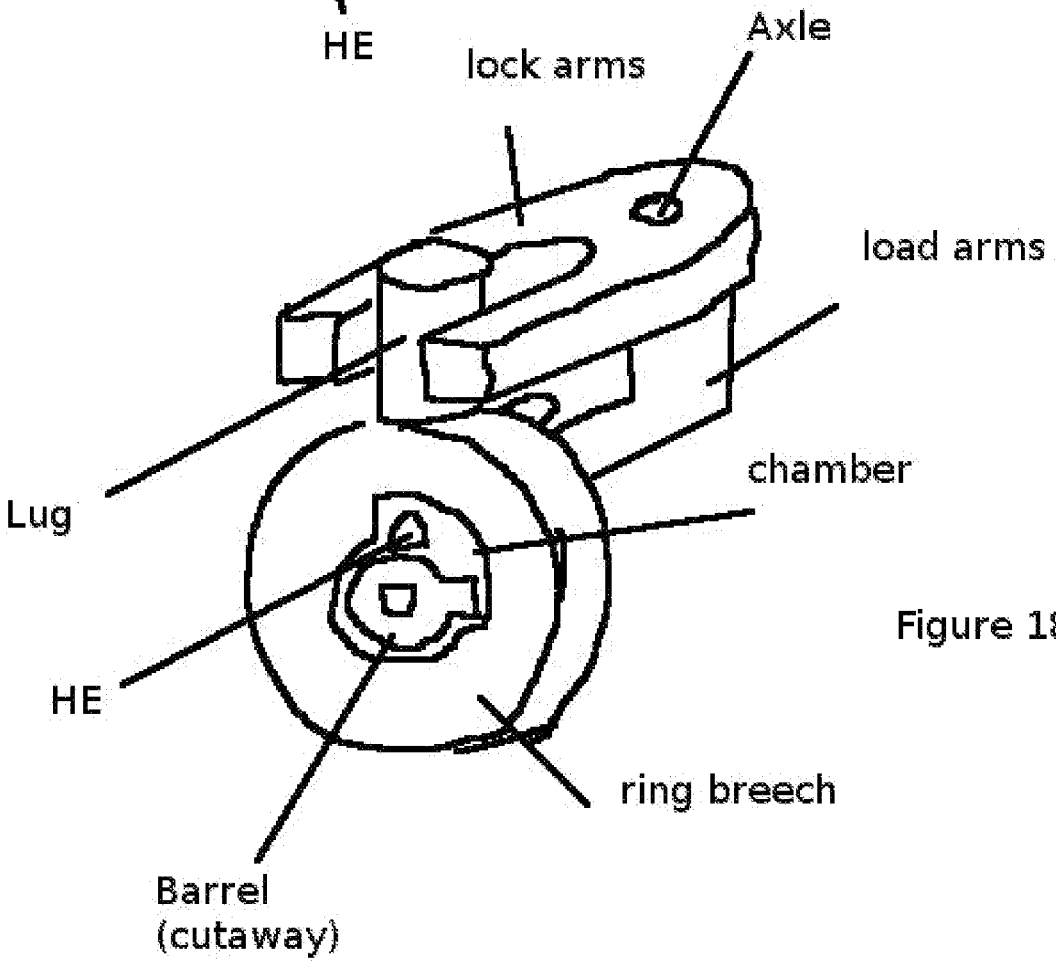
Figure 19:
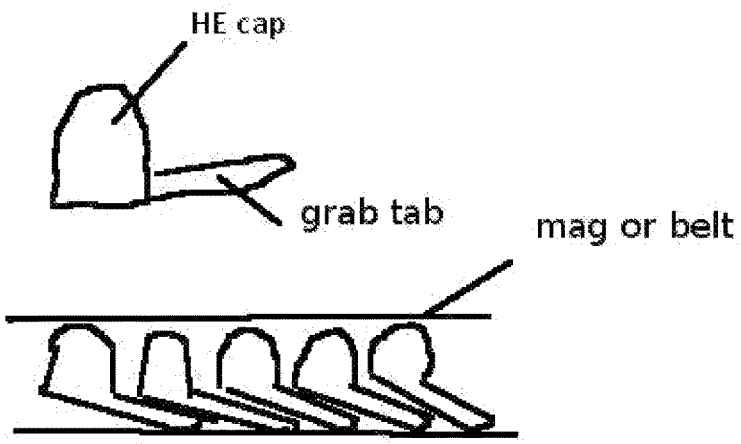
Figure 20:
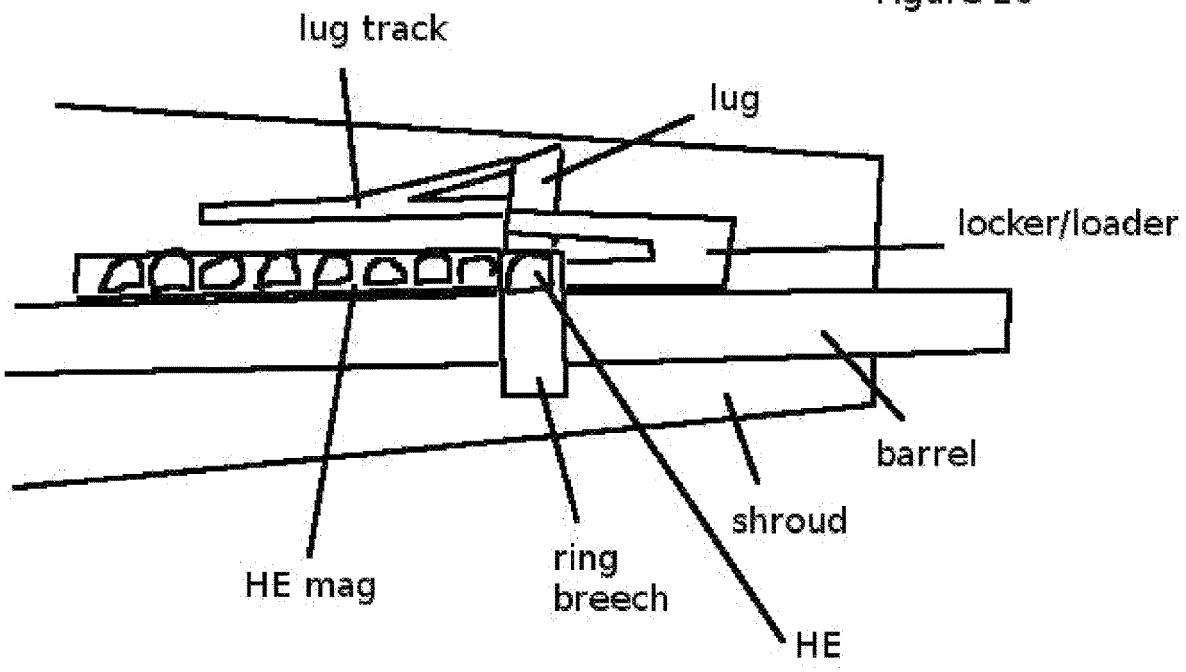

HE Cap: Cartridge containing the secondary propellant(s).

Ring Breech: Ring around barrel which twists open and closed to allow for feeding and extraction of the HE Cap.

HE Chamber: An extrusion off of the barrel which holds the loaded HE Cap. The HE Cap is "sandwiched" between the inside of the ring breech and the HE chamber when loaded, and the chamber can be shaped in such a way that the expanding HE Cap "seals and holds" the breech closed to some extent.

Ring Breech Lug: An extrusion off of the Ring Breech which "rides" in the "Lug Track" and depending on the stage of travel, twists ring open or holds ring closed. This lug is also actuated by the Locker/Loader.

Lug Track: These surfaces in the receiver/shroud hold the ring breech closed (locked) when firing and unlock/open the breech as it returns to the loading position.

Locking Gate/Unlocking Gate: This ensures the ring lug travels on the correct path within the lug track.

HE Mag: A magazine or belt or some other storage device which holds the HE Caps within the receiver/shroud, this dispenses HE Caps so that the loader arms of the locker/loader can conveniently reach and "grab" the cap during cycling of the action.

Locker/Loader: This "Arm" will grab an HE Cap from the HE mag, catch the ring breech lug on its return and load the new cap, then swing to close the ring breech by actuating (twisting) the ring breech lug into place for its next travel along the locking surface of the lug track.

Receiver: This structure holds all parts.

DETAILED DESCRIPTION OF THE INVENTION

Holistic Description:

To prepare the cannon for firing, some type of traditional autoloading mechanism retrieves a traditional cartridge or artillery projectile and gunpowder charge from a traditional magazine (including but not limited to bustle, cassette, carousel style, etc) or belt. This primary charge and projectile is then inserted into the open primary chamber of the gun and the primary breech is closed and locked. The way in which the primary charge is loaded is not claimed in this invention, nor is any projectile configuration.

To complete the loading of the gun, one or more "high explosive caps" are loaded into one or more "ring breeches" along the barrel of the gun. These are fed from a belt or magazine into the open ring breeches and the ring breech is rotated closed locking the high explosive cap(s) into the "high explosive chamber(s)" or secondary chambers.

When the primary charge is fired by mechanical, or electronic means (or any other method) the powder deflagrates pushing the projectile towards the muzzle. When the projectile reaches a predetermined distance on its travel out of the barrel, the first secondary charge is ignited by the deflagrating propellant in the barrel or by mechanical, chemical, or electronic means so that the secondary propellant further accelerates the projectile. If there are additional secondary chambers on the barrel this process repeats as many times as necessary, further increasing the velocity of the projectile.

After the projectile leaves the barrel the primary breech is unlocked and opened and the charge casing is extracted and ejected, if the primary charge is fully disintegrating, extraction and ejection is skipped, and the new primary projectile and charge is loaded. The ring breech or the ring breeches are unlocked and rotate to the open position. The spent secondary cartridges are extracted and ejected and the new secondary charges are loaded. If the secondary charge cartridges are fully disintegrating, the extraction and ejection is skipped.

As for the pressure in the barrel during firing, the secondary charges can be calibrated so that the peak pressure they generate is no more than the initial charge, less than the initial charge, or exceeding the initial charge depending on the role of the gun and the longevity requirements of the barrel and surrounding mechanisms.

Specific Description:

The ring breech is located over an inlet in the bore and opens and closes in a twisting motion around the barrel and on the same axis as the bore axis.

The ring breech can be controlled by an extrusion or "lug" allowing it to be opened and closed by an actuating arm (locker/loader) which loads the secondary charge cartridge and closes the breech. When the gun is fired the lug rides a locking surface in the barrel shroud, the "lug track", which holds the breech closed, locking the breech for the duration of firing and the recoiling travel of the gun. The shape of the secondary charge cartridge ("HE Cap") can assist in locking the ring breech as it expands, and ensures a seal within the breech.

When the gun has fired and the pressure subsides in the bore, the barrel and ring breech can move forward due to a recoil system and the ring breech lug engages a different path in the lug track. This return travel in the lug track cams and unlocks the ring breech so that when the return travel is completed the ring breech will be in the open position, able to be unloaded/loaded and closed again by the actuating arm (locker/loader).

The invention claimed is:

1. A multi-charge gun comprising:

a primary breech and at least one secondary breech, the at least one secondary breech comprising a ring-shaped breech configured to be rotated around a barrel of the multi-charge gun and over an inlet extending into a bore of the barrel;

the multi-charge gun further comprising a locker/loader device;

the ring-shaped breech comprising a ring lug;

wherein the locker/loading device is configured to interact with the ring lug to rotate the ring-shaped breech between open and closed positions around the bore; and, wherein the ring-shaped breech and a geometry of the inlet are configured to form a chamber for containing a high explosive charge (HE cap).

2. The multi-charge gun of claim 1, further comprising: a lug track, wherein the lug track interacts with locker/loader device to rotate the ring-shaped breech.

3. The multi-charge gun of claim 2, wherein the locker/loader device comprises locker arms configured to interact with the ring lug.

4. The multi-charge gun of claim 3, wherein the locker/loader device further comprises loader arms configured to load and unload the HE cap.

5. The multi-charge gun of claim 1, wherein the locker/loader device is further configured to load an unused HE cap into the chamber and unload a used HE cap from the chamber when the ring-shaped breech is in the open position.

6. The multi-charge gun of claim 1, wherein the locker/loader device comprises: locker arms and loader arms, wherein the locker arms are configured to interact with the ring lug and the loader arms are configured to load and unload the HE cap.

* * * * *